US011427380B2

(12) United States Patent
Gallick

(10) Patent No.: US 11,427,380 B2
(45) Date of Patent: Aug. 30, 2022

(54) SHIPPING PALLET ARRANGEMENT AND METHODS FOR INCREASING TRAILER LOADS TO REDUCE ROAD MILAGE AND CUT COSTS

(71) Applicant: Donald Michael Gallick, Akron, OH (US)

(72) Inventor: Donald Michael Gallick, Akron, OH (US)

( * ) Notice: Subject to any disclaimer, the term of this patent is extended or adjusted under 35 U.S.C. 154(b) by 0 days.

(21) Appl. No.: 17/060,567

(22) Filed: Oct. 1, 2020

(65) Prior Publication Data

US 2022/0106074 A1 Apr. 7, 2022

(51) Int. Cl.
*B65D 19/38* (2006.01)
*B65D 19/00* (2006.01)

(52) U.S. Cl.
CPC ..... *B65D 19/38* (2013.01); *B65D 19/0095* (2013.01); *B65D 2519/00273* (2013.01); *B65D 2519/00293* (2013.01); *B65D 2519/00323* (2013.01); *B65D 2519/00736* (2013.01)

(58) Field of Classification Search
CPC ..... B65D 19/38
USPC .. 108/57.34, 57.22, 57.21, 57.12, 56.3, 54.1
See application file for complete search history.

(56) References Cited

U.S. PATENT DOCUMENTS 3,176,632 A * 4/1965 Yingling ..... B65D 19/42 108/54.1
3,858,527 A * 1/1975 Reis ..... B65D 19/0022 108/55.1
4,062,301 A * 12/1977 Pitchford ..... B23P 19/041 108/56.1
5,816,173 A * 10/1998 Warneford ..... B65D 19/0012 108/56.3
6,003,449 A * 12/1999 Manidis ..... B65D 19/16 108/51.11
6,595,607 B2 * 7/2003 Morgan ..... A47B 67/04 312/294
6,785,920 B1 * 9/2004 Amador, Jr. ..... A47C 17/86 5/308
7,510,479 B2 * 3/2009 Stengel ..... A63H 33/32 108/25
7,802,527 B2 * 9/2010 Dong ..... B65D 19/001 108/56.1
7,959,059 B2 * 6/2011 Tamamori ..... B65D 19/44 228/212
8,347,790 B1 * 1/2013 Maiers ..... A47B 13/16 108/26
9,044,688 B1 * 6/2015 Janay ..... A63H 33/04
(Continued)

*Primary Examiner* — Jose V Chen
(74) *Attorney, Agent, or Firm* — Renner Kenner Greive Bobak Taylor & Weber; Mark L. Weber

(57) ABSTRACT

A shipping pallet arrangement includes a first pallet having a first underdeck opening to a first storage volume under a top deck, said top deck supporting goods for transport; and a first underdeck container holding goods and received within the first storage volume. A method for shipping goods in a transport container includes positioning a first pallet in the transport container, the first pallet having a first underdeck opening to a first storage volume under a top deck having goods thereon; storing goods within a first underdeck container; after the step of storing and the step of positioning, receiving the first underdeck container at least partially within the first storage volume; and after the step of receiving, shipping the transport container.

13 Claims, 10 Drawing Sheets

(56) References Cited

U.S. PATENT DOCUMENTS

2006/0254474 A1* 11/2006 Roth ..... B65D 19/0095
108/51.11
2013/0264847 A1* 10/2013 Pugh ..... A47B 83/04
297/135

* cited by examiner

SHIPPING PALLET ARRANGEMENT AND METHODS FOR INCREASING TRAILER LOADS TO REDUCE ROAD MILAGE AND CUT COSTS

TECHNICAL FIELD OF THE INVENTION

The present invention relates to shipping pallets for shipping goods, and particularly to a shipping pallet arrangement beneficially employing available volume under a top deck of a shipping pallet.

BACKGROUND OF THE INVENTION

When shipping goods in a trailer, it is most often the goal to include as many goods as possible in the trailer in order to ultimately reduce road mileage and cut costs. This is particularly true for companies such as Walmart, Home Depot, Costco, and any other company that ships such a large volume of goods that even a modest increase in packing efficiency can result in very large savings. For example, in the second quarter of 2019, Walmart's CEO announced that Walmart would be able to save at least $30 million in 2019 by switching to the use of lighter stepping stools in its distribution centers. Stepping stools are used to pack the trailers with goods all the way to the roof. This increases the load capacity and ultimately reduces road mileage and cuts costs. Merely by increasing the likelihood that workers would employ the stepping stools (apparently by making those stepping stools lighter and easier to use), Walmart estimated at least a $30 million savings for one year.

With such astounding savings from such a modest increase in potential load capacity, there is clearly an ever-present need in the art to seek the most efficient use of trailer capacity. The present invention addresses this need by providing shipping pallet arrangements and shipping methods that take advantage of trailer space that has heretofore been overlooked.

SUMMARY OF THE INVENTION

An embodiment of the present invention provides a shipping pallet arrangement comprising: a first pallet having a first underdeck opening to a first storage volume under a top deck, said top deck supporting goods for transport; and a first underdeck container holding goods and at least partially received within the first storage volume.

Another embodiment of the present invention provides a shipping pallet arrangement as in any embodiment above, wherein the pallet has a stringer or stringer board and length and width dimensions, the length being in the direction of the stringer or stringer board and extending between a first end and a second end of the pallet, the width being perpendicular to the length.

Another embodiment of the present invention provides a shipping pallet arrangement as in any embodiment above, wherein the first underdeck container is insertable and removable, in a drawer-like fashion, into and out of the first underdeck opening in the direction of the length of the pallet.

Another embodiment of the present invention provides a shipping pallet arrangement as in any embodiment above, further comprising a second underdeck container holding goods and received at least partially within the first storage volume.

Another embodiment of the present invention provides a shipping pallet arrangement as in any embodiment above, wherein the first and second underdeck containers connect to one another so as to be moved together, forming a train of underdeck containers insertable and extractable in a drawer-like fashion.

Another embodiment of the present invention provides a shipping pallet arrangement as in any embodiment above, further comprising: a second underdeck opening to a second storage volume under the top deck of the pallet; and at least a third underdeck container holding goods being received within the second storage volume, the third underdeck container being insertable and removable, in a drawer-like fashion, into and out of its respective underdeck opening in the direction of the length of the pallet.

Another embodiment of the present invention provides a shipping pallet arrangement as in any embodiment above, further comprising a fourth underdeck container holding goods and received at least partially within the second storage volume.

Another embodiment of the present invention provides a shipping pallet arrangement as in any embodiment above, wherein the third and fourth underdeck containers connect to one another so as to be moved together, forming a train of underdeck containers, insertable and extractable in a drawer-like fashion.

Another embodiment of the present invention provides a shipping pallet arrangement as in any embodiment above, wherein the first underdeck container and the second underdeck container are connected by a male member mating with a female member.

Another embodiment of the present invention provides a shipping pallet arrangement as in any embodiment above, wherein the male member is a rod and the female member is an aperture.

Another embodiment of the present invention provides a shipping pallet arrangement as in any embodiment above, wherein the first underdeck container and the second underdeck container are connected by a latch and catch mechanism.

Another embodiment of the present invention provides a shipping pallet arrangement as in any embodiment above, wherein the first underdeck container includes runners suitable to facilitate insertion and extraction of the first underdeck container.

Another embodiment of the present invention provides a shipping pallet arrangement as in any embodiment above, wherein the pallet is one of a plurality of pallets, each of the plurality of pallets having an underdeck opening to a storage volume under a top deck holding goods, said plurality of pallets arranged so that each of the underdeck openings of each of the plurality of pallets align to create an underdeck tunnel under the top decks of the plurality of pallets; and wherein the underdeck container is one of a plurality of underdeck containers, each of the plurality of underdeck containers holding goods and each being connectable to another of the plurality of underdeck containers so as to form a train of underdeck containers insertable and extractable in a drawer-like fashion into and out of the underdeck tunnel.

Another embodiment of the present invention provides a method for shipping goods in a transport container comprising: positioning a first pallet in the transport container, the first pallet having a first underdeck opening to a first storage volume under a top deck having goods thereon; storing goods within a first underdeck container; after the step of storing and the step of positioning, receiving the first underdeck container within the first storage volume; and, after the step of receiving, shipping the transport container.

DETAILED DESCRIPTION OF ILLUSTRATIVE EMBODIMENTS

Figure 1:
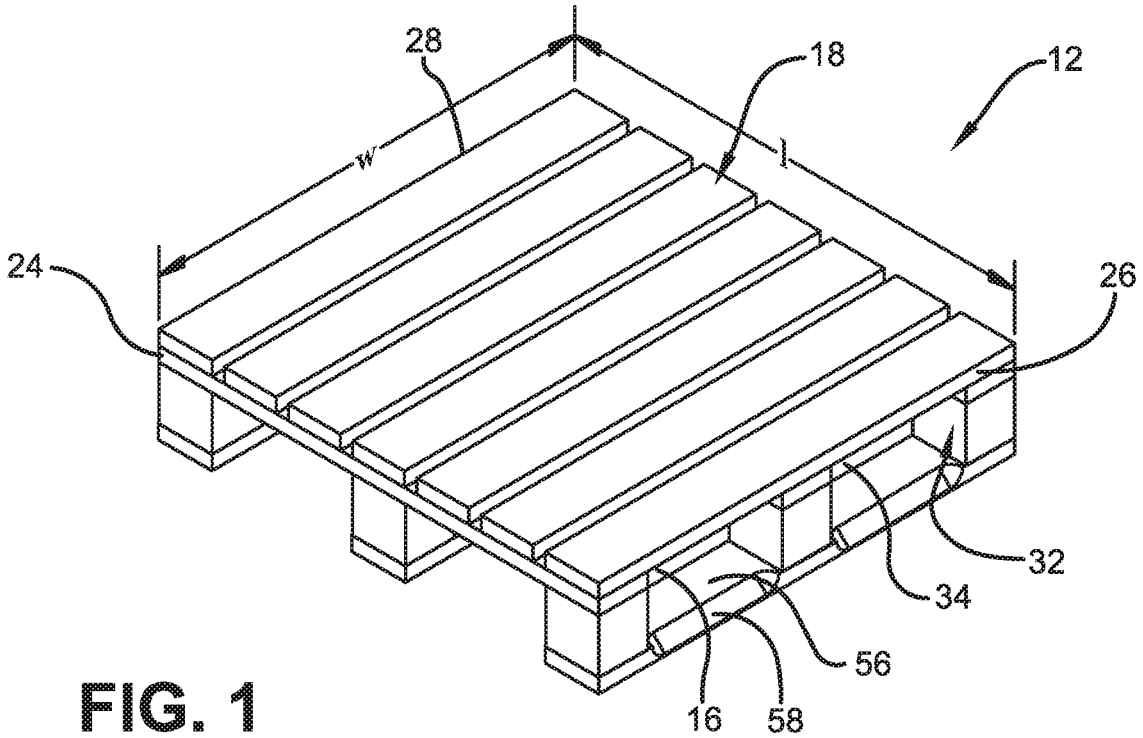
FIG. 1 is a perspective view of a first type of pallet (4-way block design) employable in the shipping pallet arrangement of the present invention.
Figure 2:
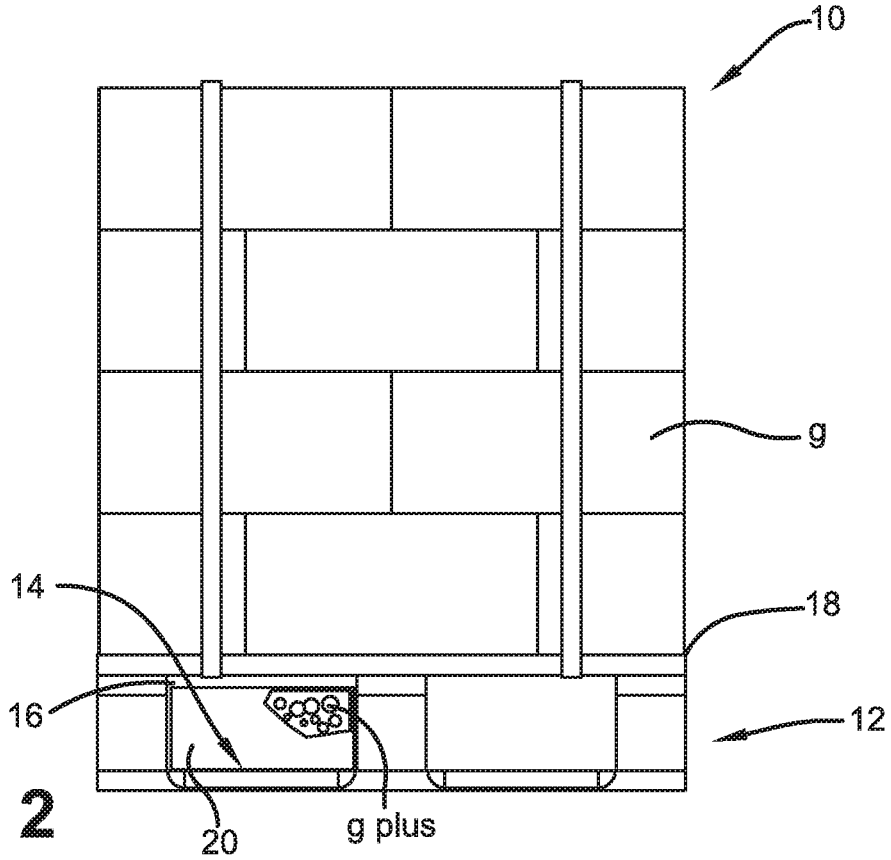
FIG. 2 is a side view of the pallet of FIG. 1 shown with goods stacked on the pallet and goods in underdeck containers.
Figure 3:
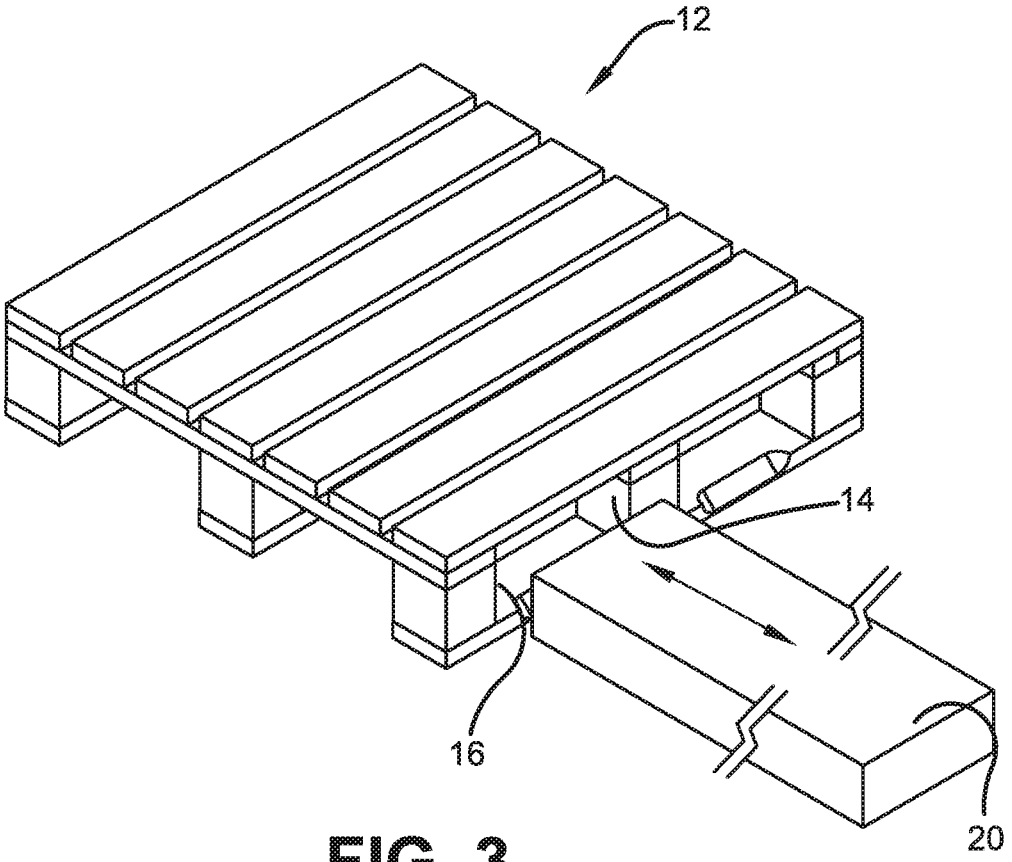
FIG. 3 is a perspective view as in FIG. 1, showing an underdeck container during insertion/extraction into/out of a storage volume under the top deck.

With reference to FIGS. 1-3, an embodiment of a shipping pallet arrangement of this invention is shown and designated by the numeral 10 (FIG. 2). The shipping pallet arrangement 10 includes a pallet 12 having an underdeck opening 14 to a storage volume 16 under the top deck 18. The top deck supports the primary goods g for transport in the normal manners currently employed. The present invention improves the art and provides the opportunity for major players to save millions of dollars by providing an underdeck container 20 holding additional goods $g_{plus}$ and being received within the storage volume 16.

FIGS. 1-3 show a block pallet design, but any of various pallets or skids fitting the following general description maybe employed in accordance with the present invention. A pallet or skid simply needs an underdeck opening that provides access to a storage volume under a top deck so that an underdeck container holding goods can be positioned under the top deck during transport.

Here forward, the pallet 12, the underdeck opening 14, the storage volume 16, and the underdeck container 20 will be referenced as the first pallet 12, the first underdeck opening 14, the first storage volume 16, and the first underdeck container 20, but use of "first" is merely so that other embodiments of the invention, particularly those embodiments that include two or more of these elements, might be more thoroughly disclosed and understood grammatically. It is intended that a shipping arrangement can have a single underdeck opening providing access to a single storage volume with a single underdeck container and yet still fall within the invention disclosed and claimed herein. Specifically, the term "first" is not to be interpreted as requiring that there must be a "second," and this is particularly true for the claims. The term "first" is again only used so that later embodiments employing second pallets, second underdeck openings, second storage volumes, and second underdeck containers can be clearly disclosed and distinguished from those first disclosed.

The terms "pallet" and "pallets" are to be understood as also covering skids or skid pallets, which typically include only a single underdeck opening to a single storage volume under the top deck.

Figure 4:
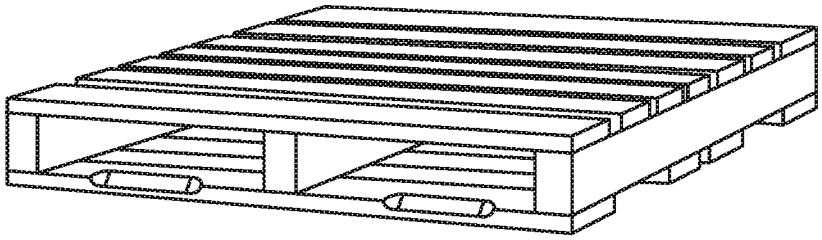
FIG. 4 is a perspective view of a second type of pallet (2-way stringer design) employable in the shipping pallet arrangement of the present invention.

Without limitation, the present invention contemplates the use of 4-way (e.g., FIG. 1) and 2-way (e.g., FIG. 4) pallets, and, without limitation, such pallets may include block pallets, double-face pallets, double-wing pallets, flush pallets, 4-way stringer pallets, non-reversible pallets, reversible pallets, single-face pallets, single-wing pallets, skid pallets, solid deck pallets, and 2-way stringer pallets. The invention is also adaptable to the widely used and regulated EURO pallet (European Pallet Association).

In some embodiments, the pallet 12 has a stringer 22 (FIG. 4) or stringer board 24 (FIG. 1) and length 1 and width w dimensions, the length 1 being in the direction of the stringer 22 or stringer board 24 and extending between a first end 26 and a second end 28 of the pallet 12, the width w being perpendicular to the length 1. As seen in FIG. 3, the first underdeck container 20 is insertable and extractable, in a drawer-like fashion, into and out of the first underdeck opening 16, in the direction of the length 1 of the pallet 12.

Figure 6:
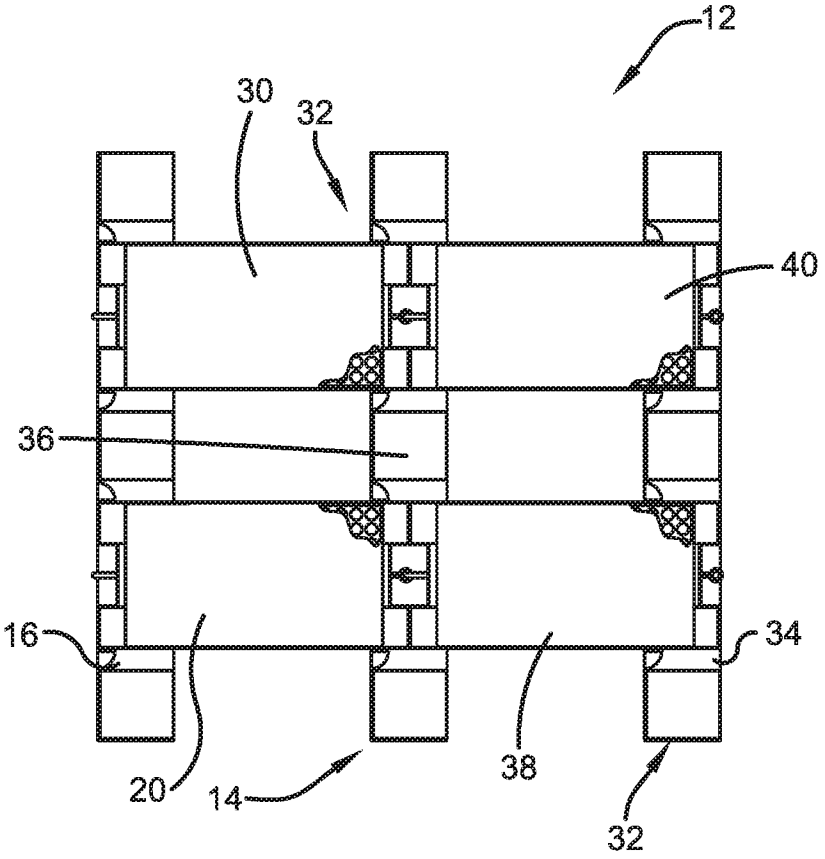
FIG. 6 is a schematic top view, with top deck removed, showing multiple underdeck containers received in a single underdeck opening.
Figure 5:
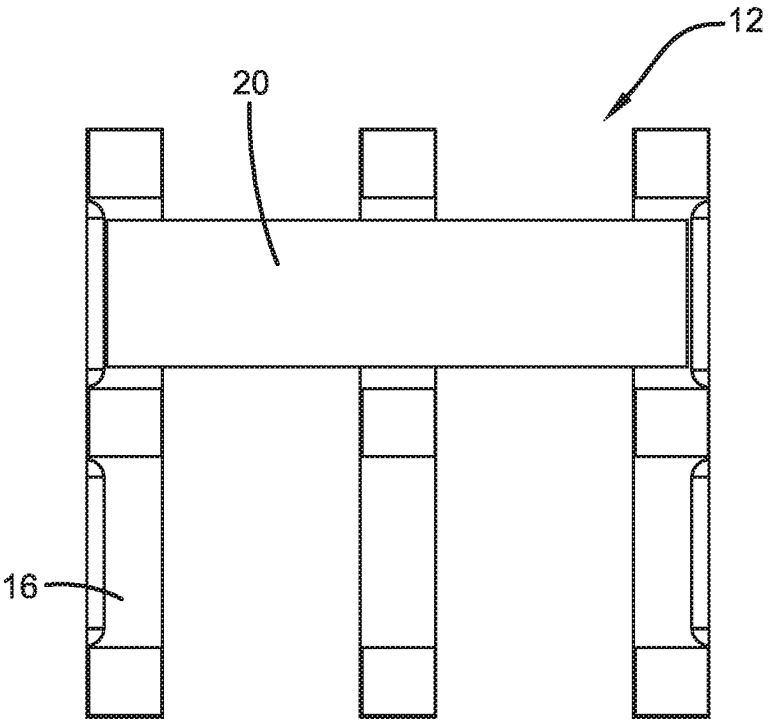
FIG. 5 is a schematic top view, with top deck removed, showing a single underdeck container received in an underdeck opening.

As shown schematically, in the top view of FIG. 5, shown with the top deck 18 removed, a single underdeck container 20 may be employed in a given storage volume (such as first storage volume 16 under a top deck 18), but embodiments of the present invention include instances where two or more underdeck containers are employed in a single storage volume, such as shown in the schematic top view of FIG. 6. Therein, in a first storage volume 16 under a top deck 18 (shown removed in FIGS. 5 and 6), both a first underdeck container 20 and a second underdeck container 30 are received within the first storage volume 16. Just as with the first underdeck container 20, the second underdeck container 30 would hold goods for shipping.

FIG. 6 also shows that, in some embodiments, underdeck containers can be made to connect one to the other, such as represented at connection 31. This can be practiced as shown, with multiple underdeck containers fitting within a single storage area or with embodiments line that in FIG. 5. In some embodiments, underdeck containers connect to one another so as to be moved together, forming a train of underdeck containers insertable and extractable in drawer-like fashion. The connections can be virtually any type, including without limitation, latch and catch types, magnetic types, hook-and-loop types, coupling link types and the like.

Figure 7:
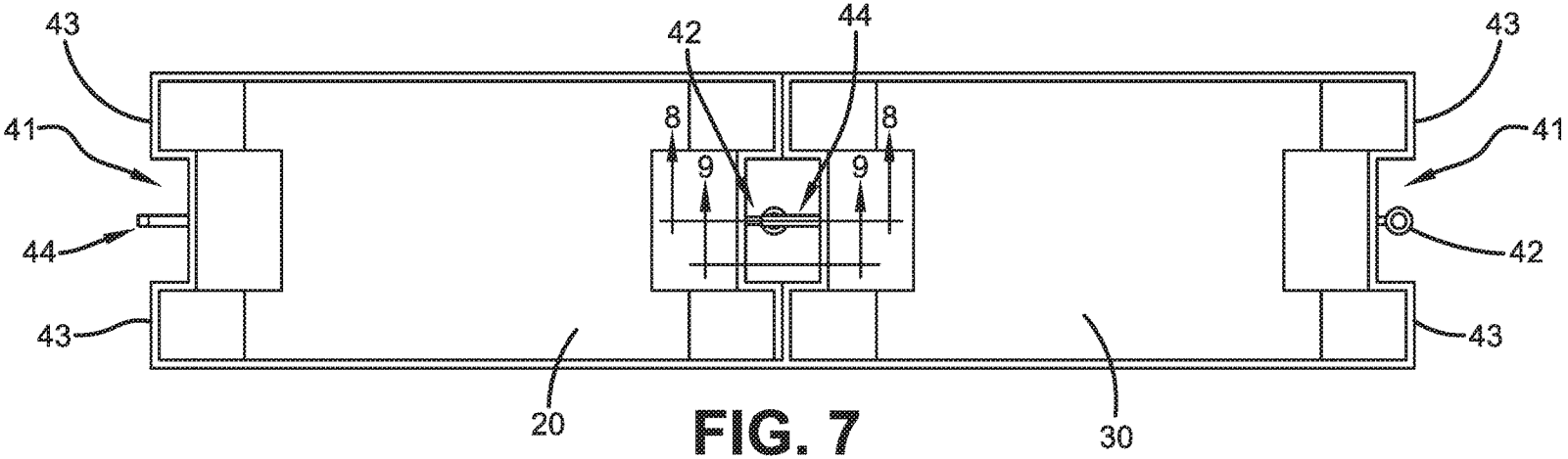
FIG. 7 is a top view of an embodiment wherein underdeck containers can connect and disconnect.
Figure 8:
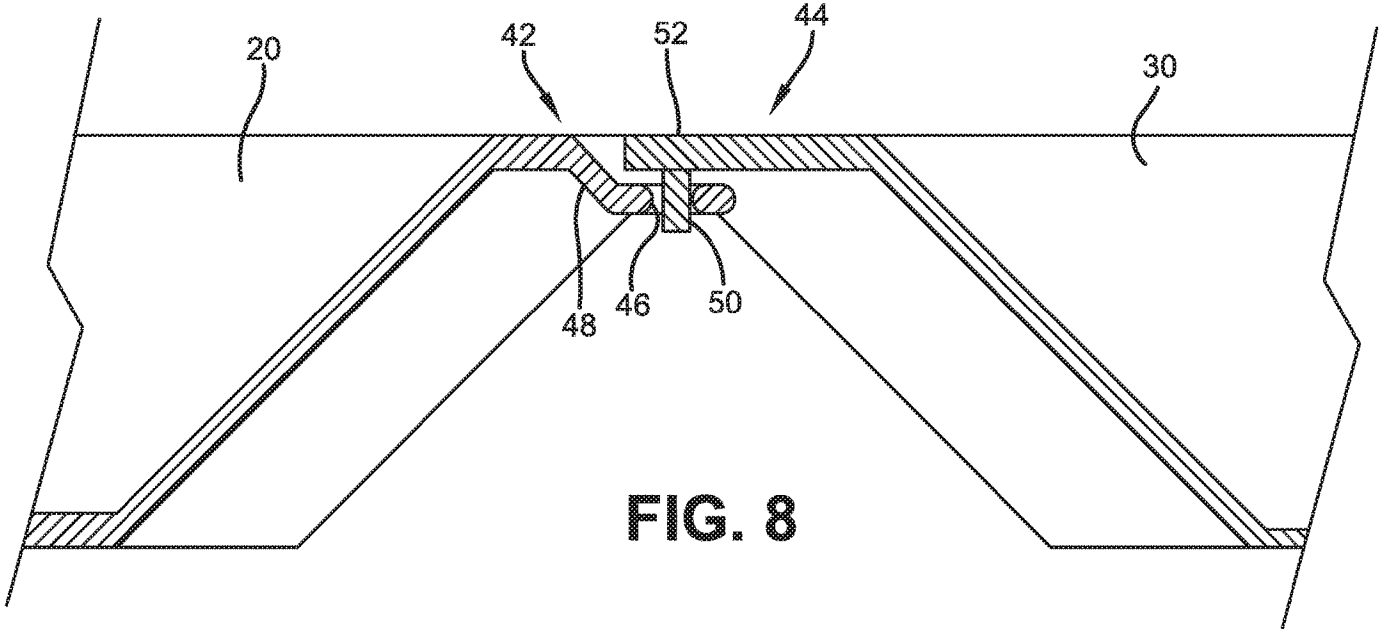
FIG. 8 is a cross-section taken along the line 8-8 in FIG. 7.
Figure 9:
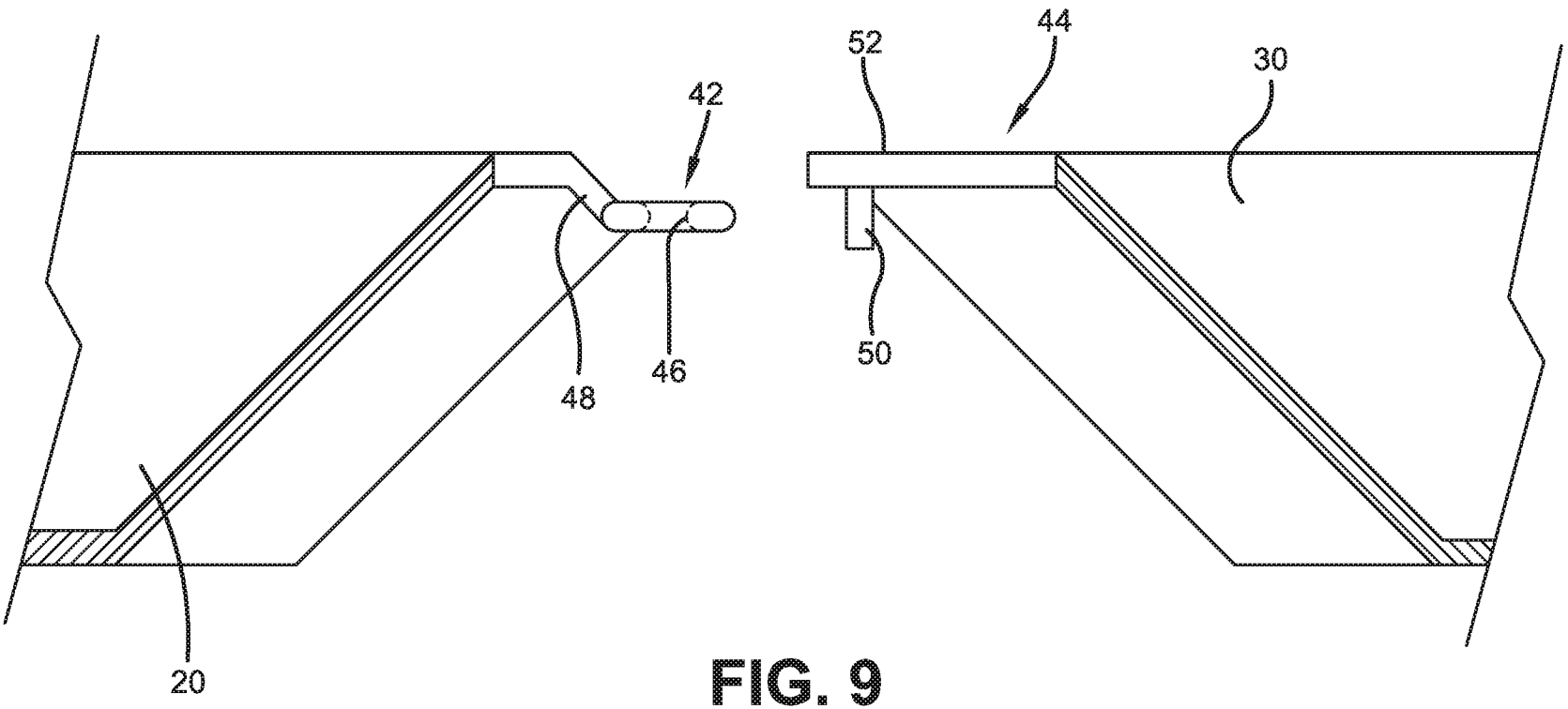
FIG. 9 is a cross-section taken along the line 9-9 in FIG. 7.
Figure 13:
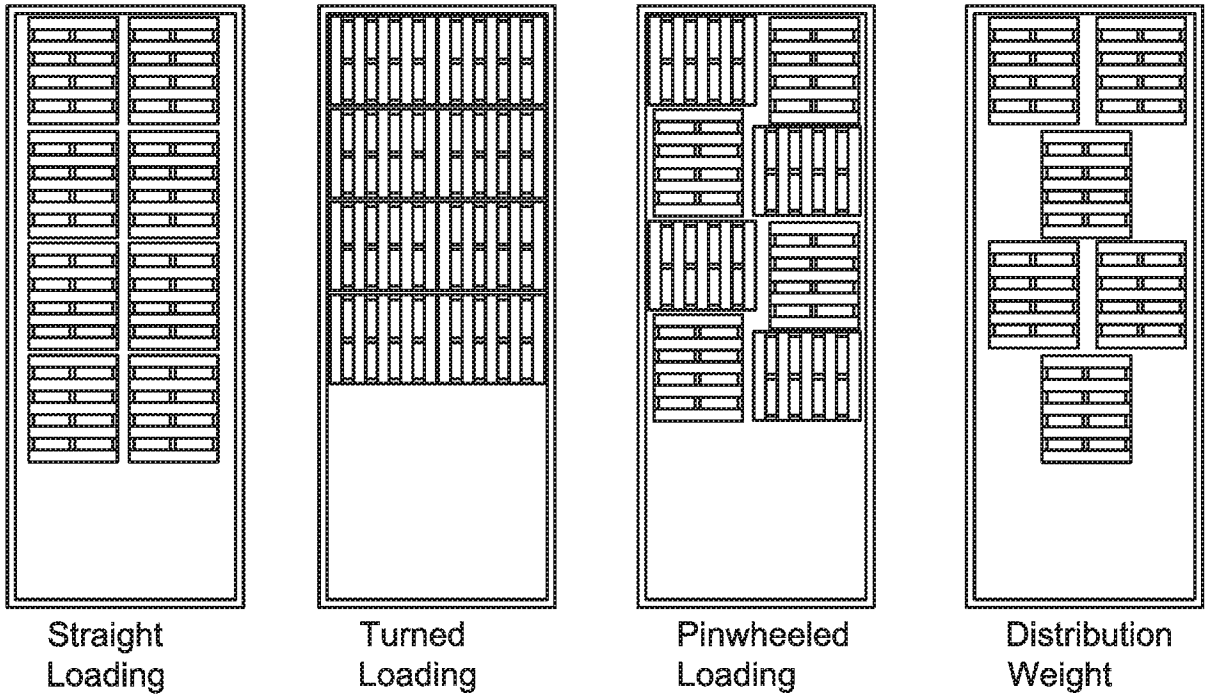
FIG. 13 shows common trailer loading patterns for pallets.
Figure 14:
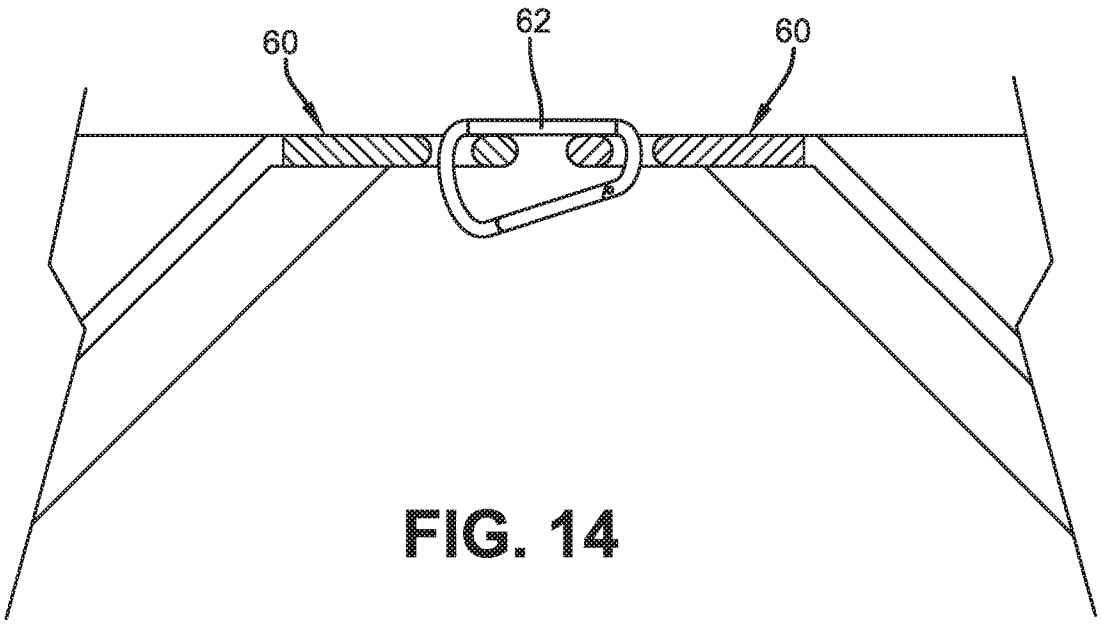
FIGS. 14 and 15 show additional examples of how underdeck containers can be connected and disconnected.
Figure 15:
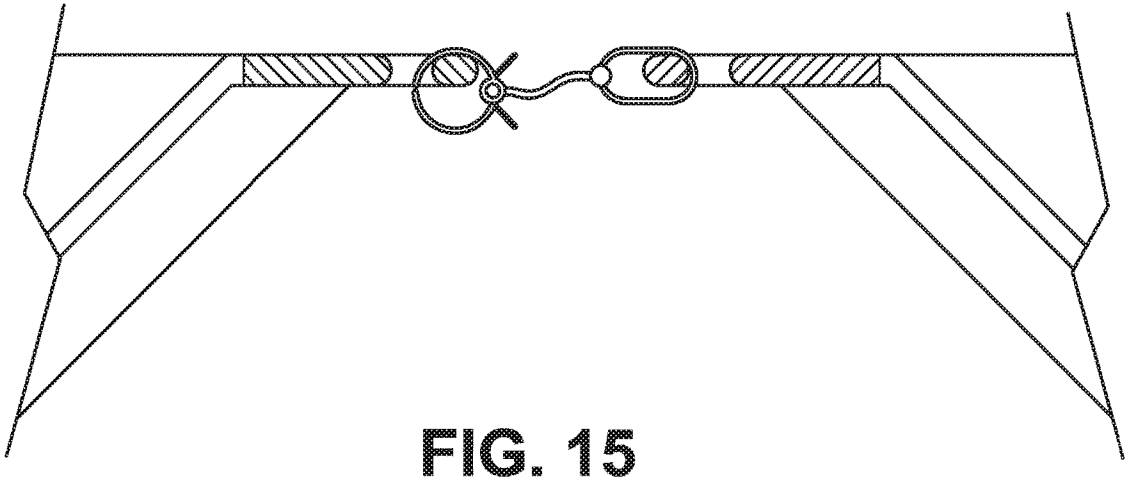

Particular latch and catch structures are shown and disclosed in FIGS. 7-9, with an aperture being a catch and a rod being a latch; in FIG. 13, with eyelets and a coupling link, with the eyelets serving as catches for a carabiner-type coupling link service as a latch; and in FIG. 14 with an aperture for a catch and a scissor clip for a latch.

With some pallets, and particularly, skid pallets, only a first storage volume is provided, but, in the more popular pallet styles, two (i.e., first and second) storage volumes are provided. Thus, in FIGS. 1 and 6, the first underdeck opening 14 and the first storage volume 16 are distinguished from a second underdeck opening 32 and a second storage volume 34 by a mid-support 36, often a middle block (as shown) or middle board further supporting the top deck. This second underdeck opening 34 can receive one or more underdeck containers as already disclosed above and schematically shown in FIGS. 5 and 6. Indeed, more than two underdeck containers could be employed in a single storage volume under the top deck.

Referring now to FIG. 6, some embodiments of the present invention further include a second underdeck opening 32 opening to a second storage volume 34, under the top deck 18 of the pallet 12, and at least a third underdeck container 38 holding goods is received within the second storage volume 34. In some embodiments, the third underdeck container 38 is insertable and extractable in a drawer-like fashion into and out of its respective underdeck opening in the direction of the length 1 of the pallet. In some embodiments, the first storage volume and the second storage volume each receive two underdeck containers, as schematically shown in FIG. 6. Thus, FIG. 6 provides a fourth underdeck container 40 holding goods and received at least partially within the second storage volume.

Figure 16:
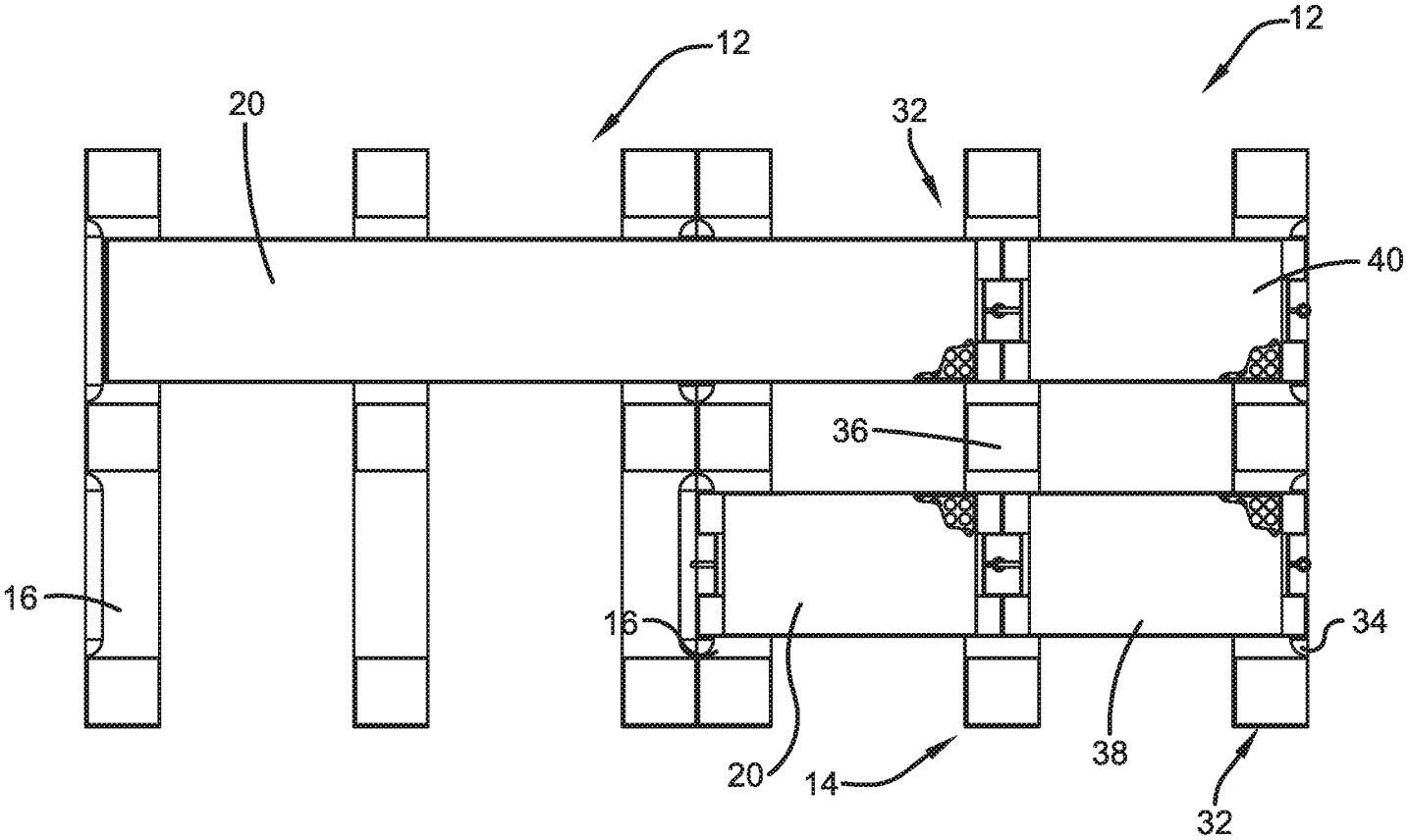
FIG. 16 is a schematic top view showing that a single underdeck container can be sized to extend through the length of at least one pallet.

In some embodiments, the third underdeck container 38 and fourth container 40 connect to one another so as to be moved together, forming a train of underdeck containers insertable and extractable in a drawer-like fashion. Because a train of underdeck containers is employed in some embodiments, it is sufficient in some embodiments that any given underdeck container can fit at least partially within a storage volume. As seen in FIG. 16, a single underdeck container 20 can be sized to extend through the length of at least one pallet. It may be found useful to allow an underdeck container to be the length of multiple pallets or any particular fraction of such length. In some embodiments, the underdeck container may be a long as the trailer in which it is to fit permits. The intent is to maximize use of the volume of the underdeck openings, and there is a balance between using that space and the cost of the labor to use that space. Different connecting structures and different container sizes may be found beneficial for certain purposes.

With reference to FIGS. 7-9, in some embodiments, the underdeck containers are connected by a male member mating with a female member. This is shown in FIG. 7 with the first underdeck container 20 having a female member 42 mating a male member 44 of the second underdeck container 30. In some embodiments, the female member 42 will simply be provided as an aperture 46 in a flange 48, the aperture 46 serving to receive a rod 50 extending from a flange 52 of the second underdeck container 30. Of course, other connectors and means for connection can be employed, but this is found suitable and efficient for product design and particularly for insertion and extraction of underdeck containers in a manner that will be more fully disclosed below.

Figure 10:
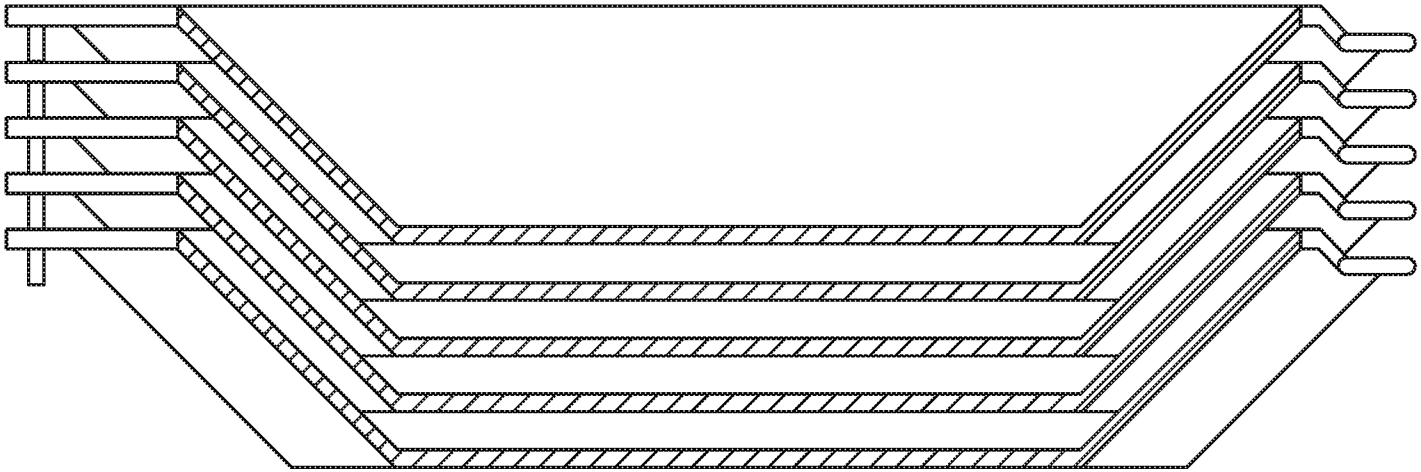
FIG. 10 is a cross-section as in FIG. 8, but showing an example of underdeck containers that stack/nest within each other.

In some embodiments, all underdeck containers are identical and nestable one within the other such that, when not in use, they can be stored stacked one upon the other. Thus, in some embodiments, the underdeck containers do not include surfaces that extend vertically (in the direction of stacking) to an extent that prohibits stackability. Instead, surfaces are angled outwardly so as to stack as exemplified in FIG. 10.

In FIG. 13, each side of the underdeck containers contain eyelets 60 and a releasable coupling link 62, here in the form of a common carabiner. In FIG. 14, one side of each of the underdeck containers would contain a spring clip 66, while the other would contain a mount for the spring clip 66, such as a simple aperture or eyelet 60.

Figure 11:
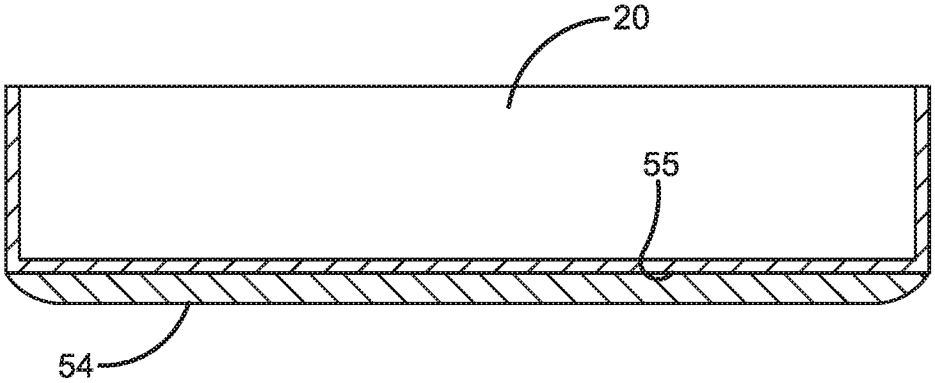
FIG. 11 is cross section view of an embodiment of an underdeck container having runners thereon.

As seen in FIG. 11, in some embodiments, the underside of an underdeck container 20 includes one or more runners 54 on the bottom surface 55, the runners being suitable to facilitate insertion and extraction of an underdeck container into and out of storage volumes under a pallet. In some embodiments, the runners 54 provide a reduced surface area of contact with the surface upon which they slide. In some embodiments, the runners 54 are a low-friction material, such as silicone or any such suitable material (with the intention to reduce the force needed to push in or pull out of the underdeck opening a container or train of containers. In some embodiments, either the front surface of the underdeck container or the front surface of the runners 54 or both are sloped (as exemplified in FIG. 11) so as to ride over minor obstacles rather than presenting an abrupt abutting face. As seen in FIG. 1, many pallets have a bottom deck board 56 with or without chamfers 58, and sloped front surfaces to either the container or the runners or both can ensure that an underdeck container inserts over the bottom deck board more easily. Because the surface that serves as the "front" depends on whether one is inserting or extracting, it will be appreciated that both ends of the runners or the containers would be sloped in some embodiments.

It should not be readily appreciated that the present invention provides advancements in shipping pallet arrangements by adventitiously taking advantage of the storage volumes defined by shipping pallets. Any number of goods are suitable for fitting in the necessarily modestly sized containers that would fit in these storage volumes provided by common pallets, and if packing a trailer to the roof can save tens of millions of dollars for some companies, certainly packing a trailer to the "floor" could also save substantial amounts of money.

With respect to labor cost, the aspect of connecting underdeck containers together and making them insertable and extractable in a drawer-like fashion ensures that labor is minimized. A first underdeck container holding goods can be inserted into an underdeck opening in a pallet, leaving exposed its connecting means at its trailing end. A new underdeck container carrying additional goods can be connected to that trailing end through its connector, and the two containers further pushed in a drawer-like fashion or train-like fashion further under the pallet. In extraction, the second container inserted would be grabbed and pulled, dragging the first underdeck container with it.

In some embodiments, such as seen in FIGS. 7-9, connectors such as female member 42 and male member 44 are positioned in recesses 41 defined by bumper portions 43. The bumper portions 43 extend such that a second underdeck container can be connected to a first underdeck container and the two pushed through the underdeck opening, with the bumper portions 43 coming into contact and protecting the connection mechanisms. Upon pulling to remove such connected underdeck containers, the connection mechanism takes over and, in the case here, the second underdeck container would pull the first underdeck container out as the second underdeck container is removed from the underdeck opening.

Figure 12:
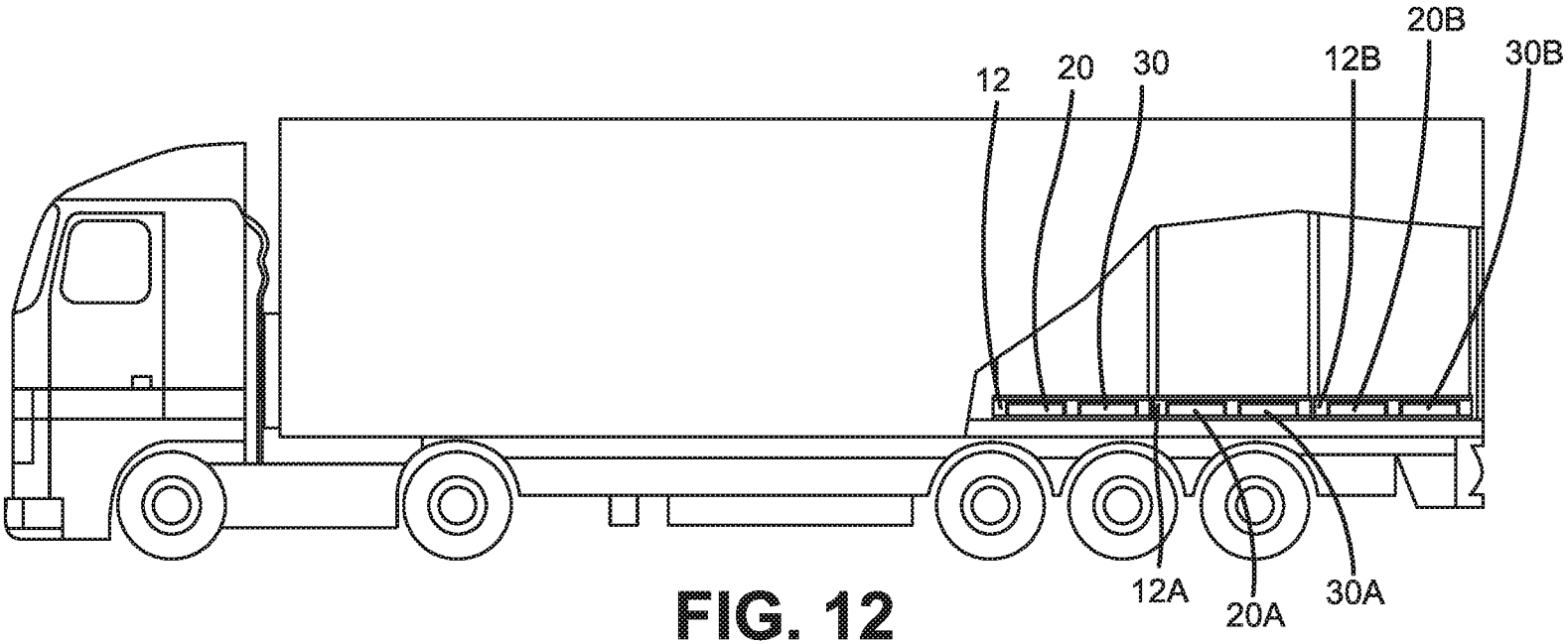
FIG. 12 is a side view of a tractor-trailer having the trailer loaded with the shipping pallet arrangements of certain embodiments of this invention, with the pallets in a straight loading pattern.

Thus, as seen in FIG. 12, the present invention contemplates wherein the pallet 12 is simply one of a plurality of pallets 12, 12*a*, and 12*b*. Each of the plurality of pallets have an underdeck opening to a storage volume under a top deck holding goods, and the plurality of pallets are arranged so that each of the underdeck openings of each of the plurality of pallets align to create an underdeck tunnel under the top decks of the plurality of pallets. With the pallets positioned in the trailer and creating an underdeck tunnel a plurality of underdeck containers 20, 30, 20*a*, 30*a*, 20*b*, 30*b*, each holding goods, can be inserted and connected one after another as described above. The pallets with two underdeck openings to two separate underdeck storage volumes will align to create two underdeck tunnels. It should be readily appreciated, with the concepts described herein, nearly the entire volume of a trailer can be advantageously packed with goods for shipment. This tunnel creation is common in "straight loading" of pallets on a trailer (See FIG. 13), and the ability to create a train of underdeck containers extending through such at tunnel greatly increases the volume of the trailer beneficially employed to transport goods.

Although not belabored in this disclosure, any type of underdeck container disclosed herein will, in some embodiments, contain a lid. The lid could be made to nest in other lids so as to be stored most efficiently.

In some uses, the train of underdeck containers can be created after straight loading of the pallets, simply feeding and pushing each successive underdeck container in a drawer-like fashion into the tunnel. Low friction runners might be found beneficial. If weight/friction prohibits such loading, a pallet could be loaded onto the trailer, then loaded with underdeck container(s), then the next pallet loaded in straight loading fashion and filled with underdeck container(s) and so on. Notably, if the efficiency of loading and unloading the underdeck containers and the value of the addition goods ($g_{plus}$) held therein warrant the extra cost in time and labor, even turned loading, pinwheeled loading, and distribution weight loading can benefit from the shipping pallet arrangements and related shipping methods disclosed herein.

Thus, the present invention contemplates a method for shipping goods in a transport container (i.e., trailer) including positioning a first pallet in the transport container, the first pallet having a first underdeck opening to a first storage volume under a top deck having goods thereon; storing goods within a first underdeck container; after the step of storing and the step of positioning, receiving the first underdeck container within the first storage volume; and, after the step of receiving, shipping the transport container. The insertion and extraction of a train of underdeck containers as described above is also contemplated in the method, the insertion occurring before shipping and extraction after arrival at a destination.

In light of the foregoing, it should be appreciated that the present invention significantly advances the art by providing shipping arrangements and methods that are structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A shipping pallet arrangement comprising:

a first pallet having a first underdeck opening to a first storage volume under a top deck, said top deck supporting goods for transport; and a first underdeck container holding goods and at least partially received within the first storage volume, wherein the first underdeck container is insertable and removable, in a drawer-like fashion, into and out of the first underdeck opening in the direction of the length of the pallet.

2. The combination of claim 1, wherein the pallet has a stringer or stringer board and length and width dimensions, the length being in the direction of the stringer or stringer board and extending between a first end and a second end of the pallet, the width being perpendicular to the length.

3. The combination of claim 1, further comprising a second underdeck container holding goods and received at least partially within the first storage volume.

4. The combination of claim 3, wherein the first and second underdeck containers connect to one another so as to be moved together, forming a train of underdeck containers insertable and extractable in a drawer-like fashion.

5. The combination of claim 4, further comprising:

a second underdeck opening to a second storage volume under the top deck of the pallet; and at least a third underdeck container holding goods being received within the second storage volume, the third underdeck container being insertable and removable, in a drawer-like fashion, into and out of its respective underdeck opening in the direction of the length of the pallet.

6. The combination of claim 5, further comprising a fourth underdeck container holding goods and received at least partially within the second storage volume.

7. The combination of claim 6, wherein the third and fourth underdeck containers connect to one another so as to be moved together, forming a train of underdeck containers, insertable and extractable in a drawer-like fashion.

8. The pallet arrangement of claim 4, wherein the first underdeck container and the second underdeck container are connected by a male member mating with a female member.

9. The pallet arrangement of claim 8, wherein the male member is a rod and the female member is an aperture.

10. The pallet arrangement of claim 4, wherein the first underdeck container and the second underdeck container are connected by a latch and catch mechanism.

11. The pallet arrangement of claim 1, wherein the first underdeck container includes runners suitable to facilitate insertion and extraction of the first underdeck container.

12. A shipping pallet arrangement comprising:

a first pallet having a first underdeck opening to a first storage volume under a top deck, said top deck supporting goods for transport; and a first underdeck container holding goods and at least partially received within the first storage volume, wherein the first pallet is one of a plurality of pallets, each of the plurality of pallets having an underdeck opening to a storage volume under a top deck holding goods, said plurality of pallets arranged so that each of the underdeck openings of each of the plurality of pallets align to create an underdeck tunnel under the top decks of the plurality of pallets; and wherein the first underdeck container is one of a plurality of underdeck containers, each of the plurality of underdeck containers holding goods and each being connectable to another of the plurality of underdeck containers so as to form a train of underdeck containers insertable and extractable in a drawer-like fashion into and out of the underdeck tunnel.

13. A method for shipping goods in a transport container comprising:

positioning a first pallet in the transport container, the first pallet having a first underdeck opening to a first storage volume under a top deck having goods thereon;

storing goods within a first underdeck container;

after the step of storing and the step of positioning, inserting the first underdeck container, in a drawer-like fashion, into the first underdeck opening and into the first storage volume, in the direction of the length of the pallet; and after the step of receiving, shipping the transport container;

after the step of shipping, removing the first underdeck container, in a drawer-like fashion, out of the first underdeck opening and out of the first storage volume, in the direction of the length of the pallet.

* * * * *